United States Patent [19]

Maack

[11] Patent Number: 4,534,107

[45] Date of Patent: Aug. 13, 1985

[54] WIRE INSERTION AND TERMINAL CRIMPING TOOL

[75] Inventor: Werner Maack, Seeheim, Fed. Rep. of Germany

[73] Assignee: AMP Incorporated, Harrisburg, Pa.

[21] Appl. No.: 587,753

[22] Filed: Mar. 9, 1984

[51] Int. Cl.[3] ..... H01R 43/00

[52] U.S. Cl. ..... 29/751; 29/753

[58] Field of Search ..... 29/751, 753, 749, 758, 29/747, 268; 72/409, 410

[56] References Cited

U.S. PATENT DOCUMENTS 3,406,558 10/1968 Tillmann et al. ..... 29/751 X 4,184,244 1/1980 Kaczmarek ..... 29/751 X

*Primary Examiner*—Carl E. Hall

*Attorney, Agent, or Firm*—F. W. Raring

[57] ABSTRACT

Apparatus for inserting a wire into a wire-receiving slot of a terminal and simultaneously crimping a U-shaped strain relief portion of the terminal onto the wire comprises a ram made up of a tool holder portion and a force transmitting portion. A crimping die and an inserter are mounted on the tool holder portion to crimp and insert during the stroke of the ram. A spring is mounted between the force transmitting portion and the tool holder portion and is preloaded to the extent that it will be compressed when a force F is exceeded, this force being the force required to crimp the strain relief portion of the terminal onto the wire. An actuator is provided which applies the required force to the force transmitting portion of the ram. The apparatus can be used to crimp and insert wires within a range of diameters.

7 Claims, 11 Drawing Figures

WIRE INSERTION AND TERMINAL CRIMPING TOOL

FIELD OF THE INVENTION

This invention relates to apparatus, such as hand tools or bench machines, for inserting wires into wire-receiving slots in terminals and simultaneously crimping a U-shaped insulation support portion of the terminal onto the wire. The invention is particularly directed to the achievement of an improved apparatus capable of crimping and inserting wires of varying diameters into terminals without adjustment for the wire diameter.

BACKGROUND OF THE INVENTION

A commonly used type of electrical terminal has one or more wire-receiving slots and an adjacent U-shaped strain relief portion. When the terminal is installed on a wire, the wire is moved into the wire-receiving slot or slots and the U-shaped strain relief portion is simultaneously crimped onto the wire.

The known types of tools for inserting the wire into the slot and simultaneously crimping the strain relief portion of the terminal onto the wire comprise a single ram on which a wire inserter and a crimping die are mounted. Heretofore, it has been found necessary to mount at least one of the tools, the inserter or the crimping die, adjustably on the ram in order to permit use of the tool with wires of more than one diameter, that is with wires that lie within a predetermined range of diameters. If the tool has an adjustment feature of this type and if the technician makes the required adjustment for the particular wire which is being used, good electrical connections will be obtained between the conducting core of the wire and the wire-receiving slot and good crimped connections will be obtained in the strain relief portion of the terminal. However, the technician will sometimes neglect to make the required adjustments to the tool or he may be misinformed as to the diameter of the wire which is being supplied to him and the tool will not be properly adjusted for the wire size. When this happens, inferior electrical connections will result or the crimped connection will not be properly made.

The present insertion is directed to the achievement of an improved tool of the general class described above which does not require adjustment for different wire diameters provided the wire diameter lies within a predetermined range of wire diameters.

THE INVENTION

The invention comprises an inserting and crimping apparatus for inserting a wire into the wire-receiving slot of an electrical terminal and simultaneously crimping the U-shaped insulation support portion of the terminal onto the wire. The wire has a diameter which lies within a predetermined diameter range and the force required to crimp the insulation support portion is substantially equal to a value F for all wires having a diameter within the predetermined range. The apparatus is of the type comprising a work holder for holding the terminal in a predetermined position, a ram which is reciprocable along a rectilinear path towards and away from a terminal in the work holder, a wire positioner on the path for holding the wire with its axis in alignment with the wire-receiving slot in the terminal and in alignment with the insulation support portion, an inserter on the ram for moving the wire onto the wire-receiving slot, a crimping die on the ram which crimps the insulation support portion onto the wire during movement of the ram towards the terminal, and an actuator for moving the ram along the rectilinear path and applying the force F required. The apparatus is characterized in that the ram is a composite member comprising a tool holder portion and a force transmitting portion which is in alignment with the tool holder portion. The crimping die and the inserter are on the tool holder portion and the actuator is in engagement with the force transmitting portion and is effective to move the actuator or force transmitting portion along the rectilinear path. A force transmitting compressible coupling is provided between the tool holder portion and the force transmitting portion. The coupling is compressible upon application thereto of the force F which is required to crimp the insulation support portion onto the wire and is substantially incompressible under a force which is less than F. During insertion of a wire into the wire-receiving slot of the terminal and crimping of the insulation support portion onto the wire, the resilient coupling will be compressed to an extent which will depend on the diameter of the wire, the extent of compression being greater for a larger diameter wire than for a smaller diameter wire.

In accordance with a further embodiment, the compressible coupling comprises a compressed spring which is interposed between the force transmitting portion and the tool holder portion. A further embodiment is characterized in that the tool holder portion of the ram is telescopically received in an axial bore in the force transmitting portion and the compressed spring is in the axial bore. A further embodiment is characterized in that the tool holder portion and the force transmitting portion are maintained in assembled relationship by a lost motion coupling which permits relative movement of the force transmitting portion towards the tool holder portion with accompanying compression of the spring. In one embodiment, the last motion coupling comprises a fastener extending slidably through the force transmitting portion to the tool holder portion and is fixed to a tool holder portion.

THE DRAWING FIGURES

FIG. 1 is a side view, partly in section, of a hand tool in accordance with the invention.

FIGS. 2, 3, 4, and 5 are diagramatic views which illustrate the use of the tool with a relatively small diameter wire (FIGS. 2 and 3) and with a relatively large diameter wire (FIGS. 4 and 5).

FIGS. 6 and 7 are views taken along the lines 6—6 and 7—7 of FIG. 5.

FIGS. 8 and 9 are views taken along the lines 8—8 and 9—9 of FIG. 3.

THE DISCLOSED EMBODIMENT

Figure 10:
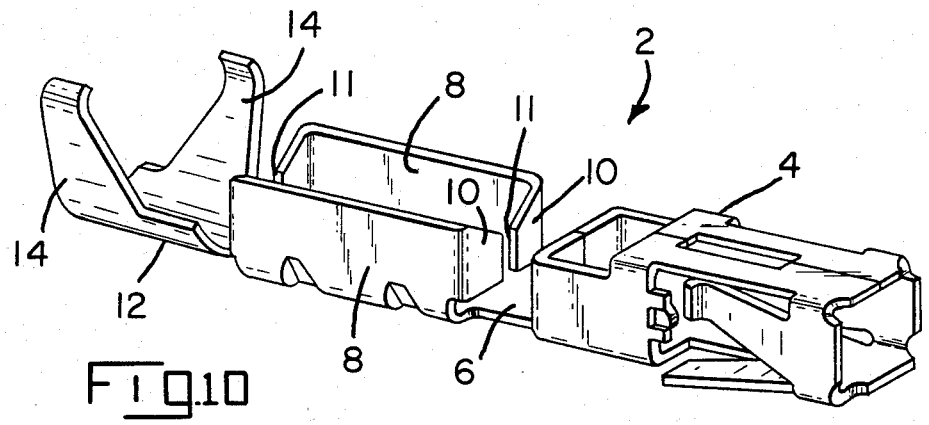
FIG. 10 is a perspective view of a typical terminal of the type used in the practice of the invention.

The invention comprises a tool or apparatus for inserting a wire 16 into a slot in a terminal as shown at 2, FIG. 10, and simultaneously crimping the insulation support portion 12 of the terminal onto the wire. The terminal and the inserting and crimping tool as shown in FIG. 11 will first be described in order to provide background information for the description of the tool of FIG. 1.

The terminal 2 comprises a socket portion 4 from which a flat web 6 extends. Sidewalls or ears 8 extend upwardly from the side edges of the web 6 and these ears have inwardly directed flanges 10 at their ends. The opposed edges of these flanges are spaced apart so that wire-receiving slots 11 are provided, the width between the opposed edges being such that they will penetrate the insulation of the wire 16 and establish contact with the strands 18 in the core of the wire.

The terminal has an integral U-shaped strain relief portion 12 which has staggered upwardly extending arms 14 that are crimped onto the wire so that the wire will be gripped adjacent to the slots 11 and a tensile pull applied to the wire will not disturb the electrical connection.

Figure 11:
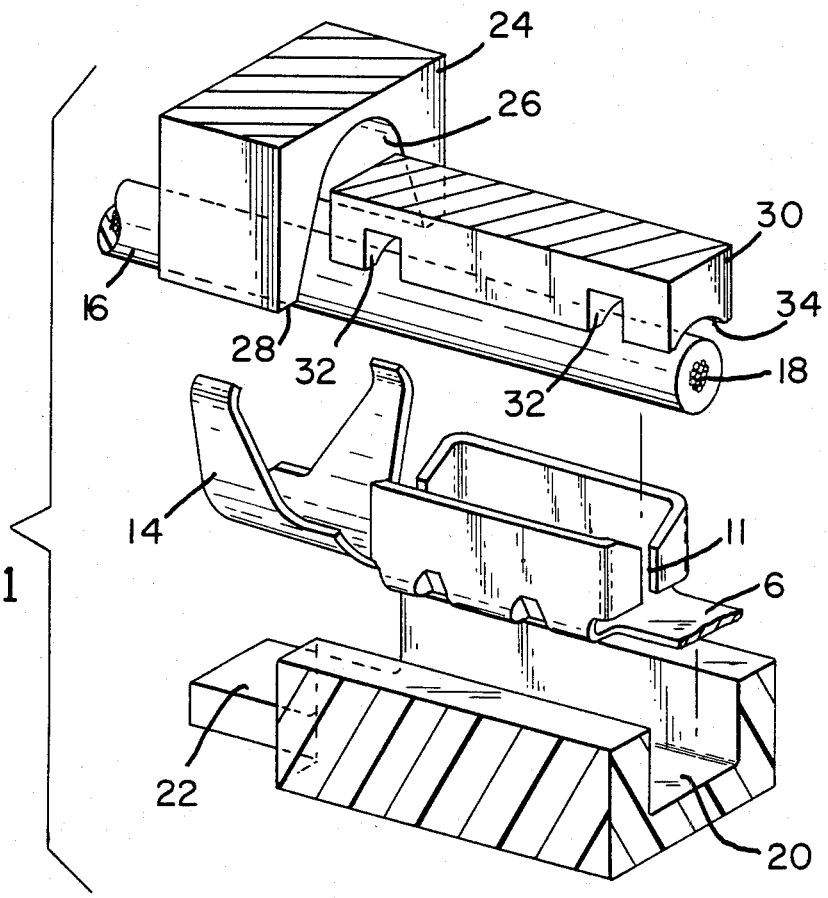
FIG. 11 is a perspective view showing details of the crimping and inserting tools for inserting a wire into the terminal and crimping the insulation support portion of the terminal onto the wire.

FIG. 11 shows the essential elements of an apparatus for inserting and crimping as described above when the terminal 2 is installed on the end of a wire 16. The apparatus comprises a channel or support 20 within which the central portion of the terminal is supported when the wire is inserted into the slots 11. An adjacent surface 22 is provided which supports the insulation support portion 12 of the terminal. The arms 14 of the insulation support portion are crimped onto the wire by a crimping die 24 which has inwardly extending forming surfaces 26 on its lower side 28. Downward movement of this die 24 will cause the arms 14 to bend inwardly and to be formed onto the wire. The wire is inserted into the slots 11 by an inserter 30 which has transversely extending slots 32 on its underside 34. The slots provide clearance for the flanges 10 so that when the inserter movement downwardly, the wire is engaged by the arcuate underside 34 of the inserter and pushed into the slots.

Ordinarily, the inserter 30 and the crimping die are provided on the reciprocable ram of the apparatus which is used to install terminals on the ends of wires 16. It has heretofore been thought that if the wire diameter is changed, the tooling must be adjusted to compensate for the new wire size. Accordingly, it has been common practice to mount the inserter or the crimping die on the ram with a provision for adjustment so that its position relative to the ram can be changed when the wire size is changed.

Figure 6:
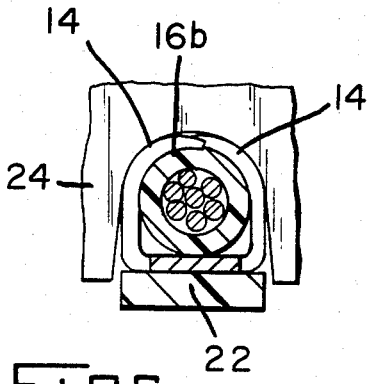
Figure 7:
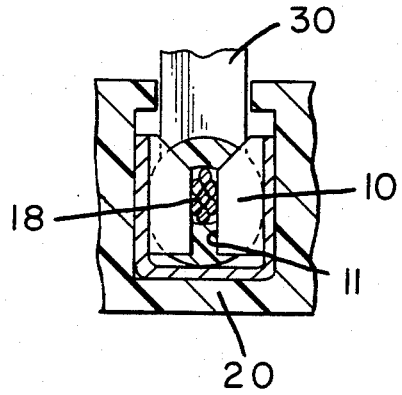

I have discovered that in fact, wires within a predetermined range of wire diameters can be used without adjustment of the tool if the tool has features described below which apply a predetermined crimping force F to the insulation support portion 12 of the terminal. Referring to FIGS. 6–9, when a relatively large diameter wire is used with a tool as described below, the arms 14 are crimped onto the insulation as shown in FIG. 6 so that the cross section of the wire remains essentially circular. As shown in FIG. 7, where a large diameter wire is used in the practice of the invention, the strands of the wire will be located adjacent to the upper end, as viewed in FIG. 7, of the slot 11. It is to be understood that the arms 14 are snugly crimped onto the wire 16 in FIG. 6 notwithstanding the fact that the wire is circular in cross section.

Figure 8:
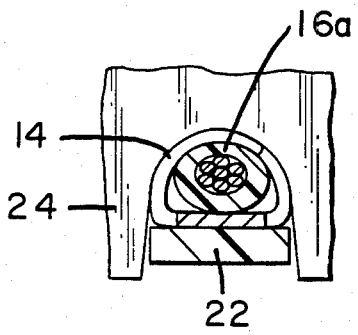
Figure 9:
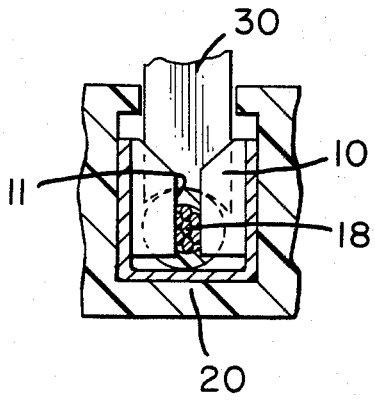

If a small diameter wire is used in the practice of the invention, FIGS. 8 and 9, the arms are severely bent and the wire is visibly compressed to the extent that it assumes an oval-shaped cross section. With the smaller diameter wire, the strands are located in the lower portion of the slot 11 as shown in FIG. 9. As will be explained below, the force required to crimp the insulation support portion on the large diameter wire is substantially the same as the force required to crimp the insulation support portion on the smaller diameter wire as shown in FIG. 8.

Figure 1:
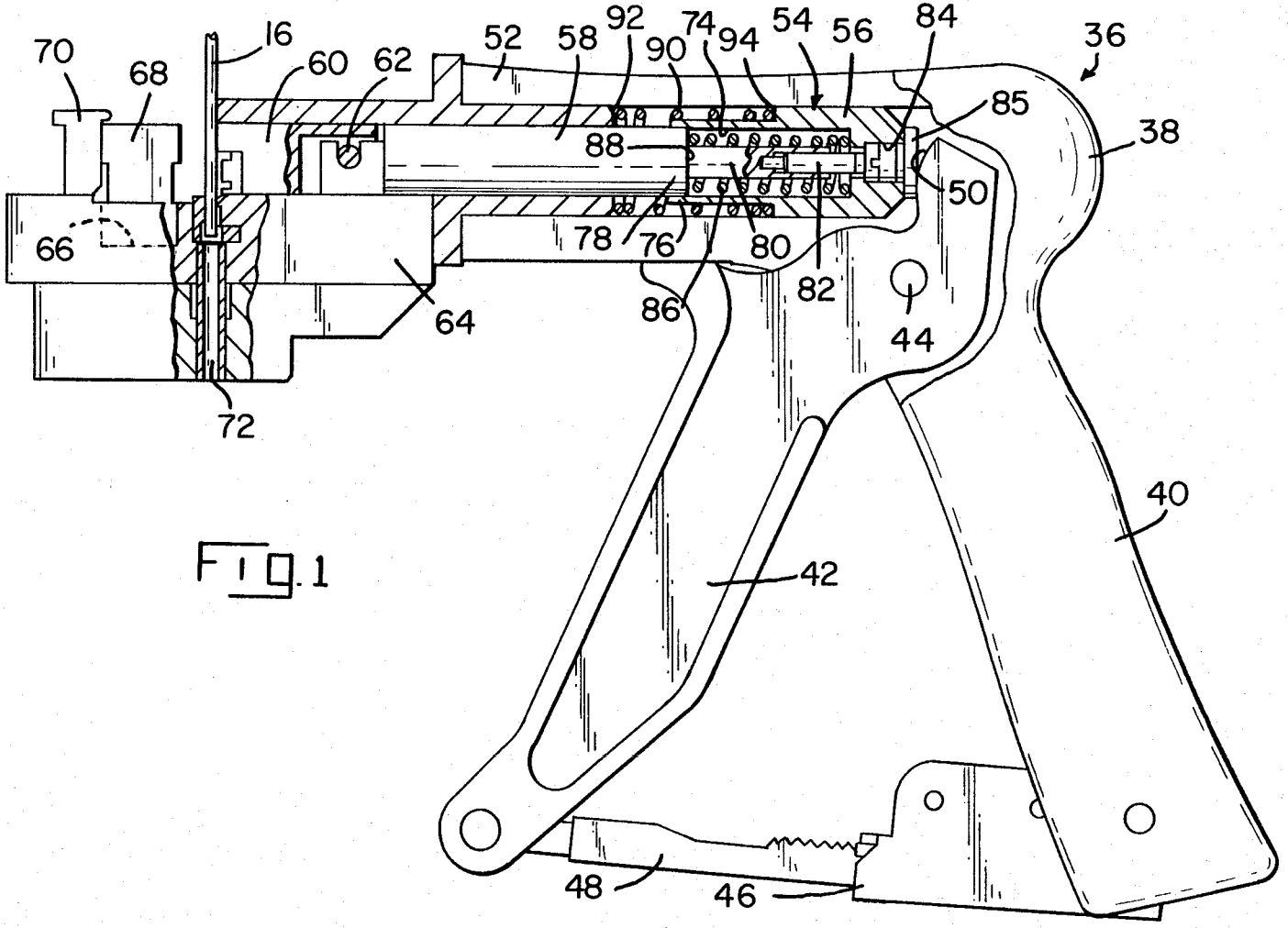

Turning now to FIG. 1, a tool 36 in accordance with the invention comprises a frame 38 having a fixed handle 40 and a movable handle 42 which is pivoted to the frame at 44. A full stroke compelling mechanism 46 is provided between the handles so that when the operator begins to move the handle 42 towards the handle 40, the handle 42 must be moved through its entire stroke before it can be returned to its starting position. Mechanisms of this type are widely known and comprise a rack bar 48 which cooperates with a pawl (not shown) in the housing 46.

The upper end 50 of the handle 42 serves as the force applying end and bears against a bearing plate 85 on a composite ram 54 which is slidably contained in a bore in an extention 52 of the frame. The ram 54 comprises a force transmitting portion 56 and a tool holder portion 58. A tooling block 60 is secured on the end of the tool holder portion 58 by a pin coupling 62 and this forward portion is supported on a mounting block 64 which extends forwardly of the frame. A recess 66 is provided in the block 64 for a connector housing 68 and a support 70 is provided on the upper surface to support the housing during crimping and insertion of the wire. It will be understood that the connector housing 68 will contain a plurality of terminals of the type shown at 2. An opening 72 extends through the block 64 for the wire 16 to locate the wire in alignment with the crimping die 24 and the inserter 30 which are integral with the tooling block 60. As with previous tools of the general type shown in FIG. 1, the end portion of the wire is trimmed by the lower edge of the inserter when the tooling block 60 moves leftwardly from the position shown in FIG. 1.

The crimping die 24 and the inserter 30 are both rigidly secured to the block 60 which in turn is connected by the pin coupling 62 to the tool holder portion 58 of the ram. No adjustments of any of these parts are required in accordance with the practice of the invention.

The force transmitting portion 56 of the ram has an axial bore 74 which extends inwardly from its left-hand end 76, as viewed in FIG. 1, and the trailing end 78 of the tool holder portion 58 is slidably received in this bore. The tool holder portion has a reduced diameter extension 80 which is within the bore 74 and this reduced diameter extension has a threaded opening extending inwardly from its right-hand end. A set screw 82 is threaded into this opening and extends rightwardly through an oversized opening at the inner end of bore 74 and into a smaller diameter bore 84 in the right-hand end of the force transmitting portion. Rotation of the set screw will thus cause relative movement of the tool holder portion with respect to the force transmitting portion 56. A spring 86 surrounds the reduced diameter portion 80 and bears against the shoulder 88 which is provided between the ends 78 of the tool holder portion 58 and the reduced diameter extension 80. At its right-hand end, this spring 86 bears against the inner end of the bore 74.

Proper calibration of the tool requires that the set screw 82 be adjusted to compress the spring 76 such that it exerts a force between the two parts of the ram equal to the force F which is required to crimp the strain relief portion of the terminal onto the wire.

The reduced diameter bore 84 is closed by a plug 85 that provides a bearing surface for the upper end 50 of the handle 42. It will be apparent that counterclockwise movement of handle 32 will thus cause the composite ram 54 to be moved leftwardly from the position shown.

Figure 2:
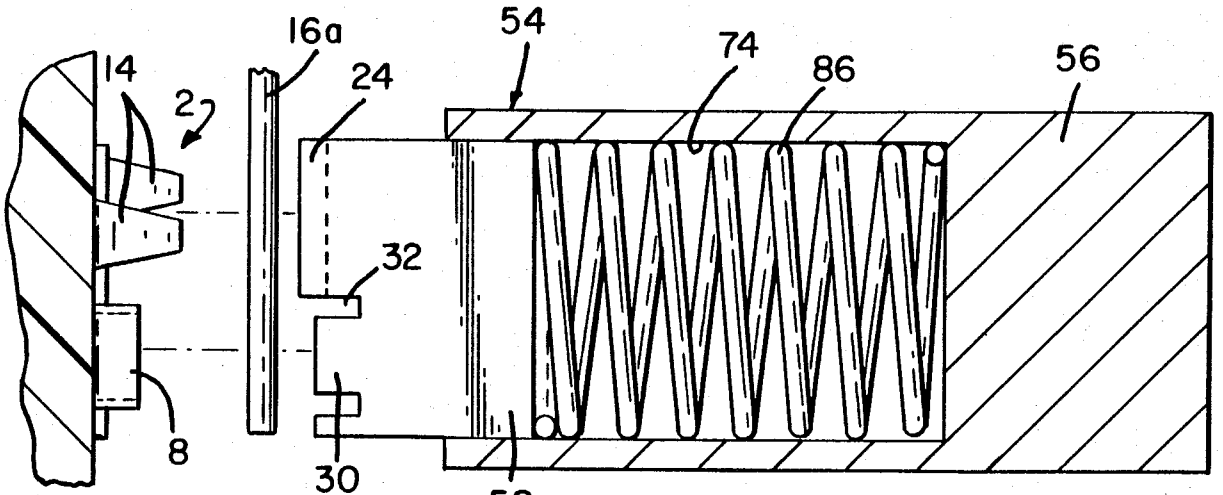
Figure 3:
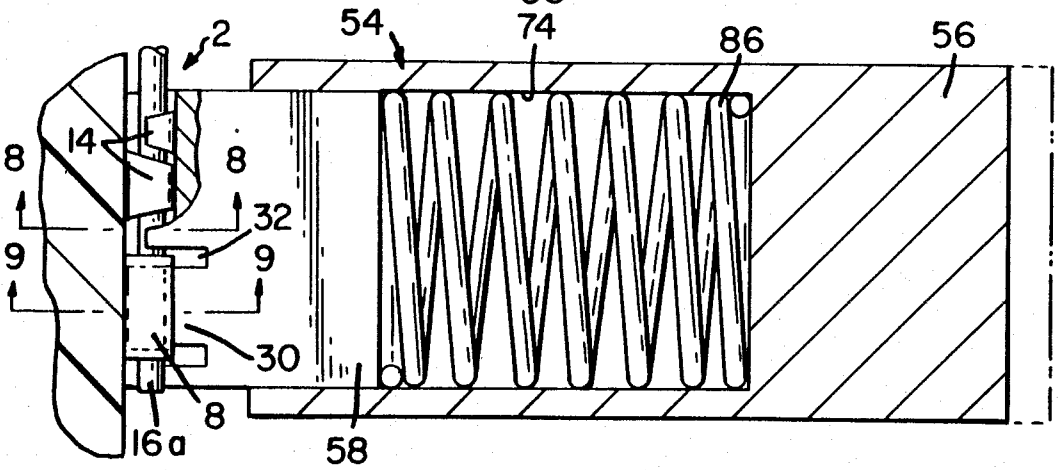

FIGS. 2 and 3 illustrate diagramatically the manner in which a relatively small diameter wire 16(*a*) is accommodated in the practice of the invention when the wire is inserted into the slots of the terminal and the insulation support portion of the terminal is crimped onto the wire. When the composite ram 54 moves leftwardly from the position of FIG. 2, the wire is fully inserted into the wire-receiving slots 11, that is to the lower portions of the slots as shown in FIG. 9 and the arms 14 of the strain relief portion of the terminal are collapsed onto the wire as shown in FIG. 8. The crimping of the arms 14 is accomplished by applying a force F to the arms by the ram 54. At the end of the stroke, FIG. 3, the spring 86 should either be about to be compressed or should be compressed by a very slight amount. As a practical matter, it is preferable to adjust the tool so that a very slight compression of the spring does take place and it will thus be assured that the force F is in fact applied to the strain relief portion of the terminal. The compression of the spring however is so slight that it is not shown in FIG. 3.

Figure 4:
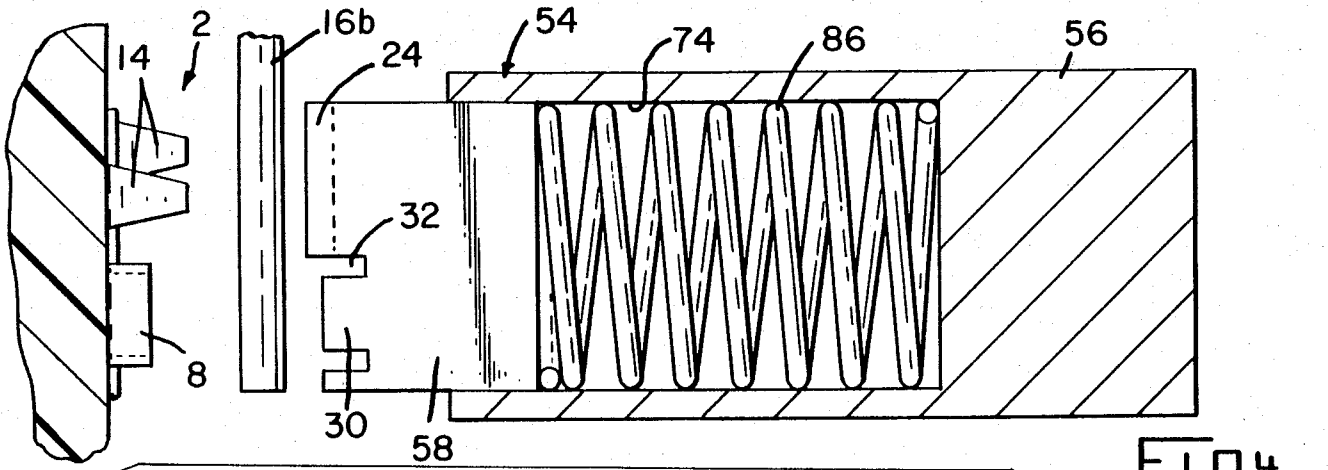
Figure 5:
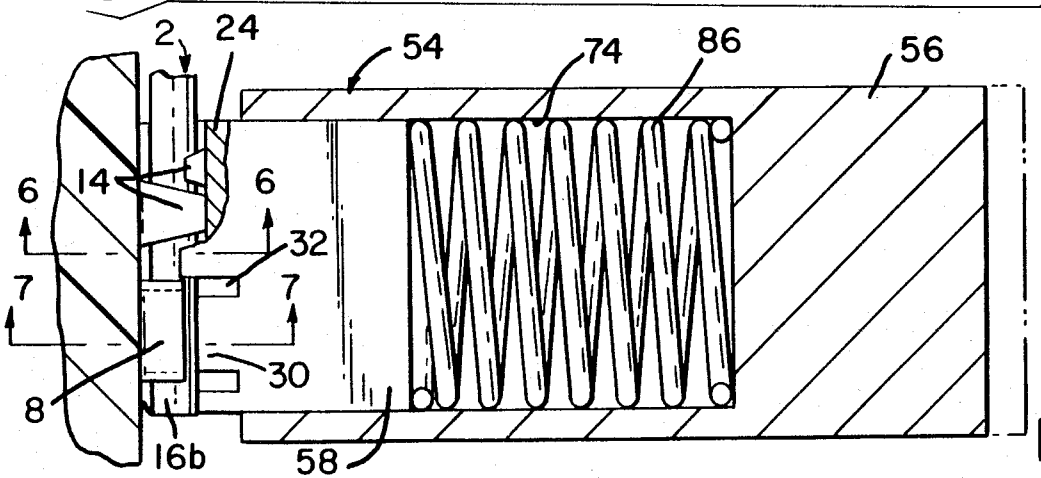

FIGS. 4 and 5 illustrate the practice of the invention with a relatively large diameter wire 16(*b*). In this instance, the tool holder portion of the composite ram moves a lesser distance than it moves in FIGS. 2 and 3 since the arms are bent onto the large diameter wire 16(*b*) with less displacement of the arms taking place, compare FIGS. 6 and 8. There is a significant amount of overtravel of the force transmitting portion of the ram with respect to the tool holder portion as is evident from a comparison of FIGS. 4 and 5. As shown in FIGS. 6 and 7, and as previously noted, the strands of the wire are in this instance disposed in the upper portions of the wire-receiving slots 11.

The force F is substantially the same in both of the extreme cases illustrated in FIGS. 2–5 even though there is some compression of the spring 86 in FIGS. 4 and 5. The compression of the spring 86 does not significantly affect the total force F if the spring is a relatively long spring and is compressed significantly when it is installed in the tool. In other words, the spring has a relatively constant and low spring rate over the range of compression shown in FIGS. 4 and 5. Additionally, it must be borne in mind that the actual amount of compression is relatively slight.

A return spring 90 is also provided on the composite ram and acts between a shoulder 92 of the frame and a shoulder 94 on the force transmitting portion of the ram. This is a relatively light spring which is easily compressed when the ram is moved leftwardly from the position shown.

It will be apparent from the foregoing that the practice of the invention avoids the need to provide an adjustable crimping die or an adjustable inserter of the known types of tools used to insert wires into terminals and simultaneously crimp an insulation support portion of the terminal onto the wire.

I claim:

1. An inserting and crimping apparatus for inserting a wire into the wire-receiving slot of an electrical terminal and simultaneously crimping the U-shaped insulation support portion of the terminal onto the wire, the wire having a diameter which lies within a predetermined range, the force required to crimp the insulation support portion being substantially equal to F for all wires having a diameter within the predetermined range, the apparatus being of the type comprising a work holder for holding the terminal in a predetermined position, a ram which is reciprocable along a rectilinear path towards and away from a terminal in the work holder, a wire positioner on the path for holding the wire with its axis in alignment with the wire-receiving slot in the terminal and in alignment with the insulation support portion, an inserter on the ram for moving the wire onto the wire-receiving slot, a crimping die on the ram which crimps the insulation support portion onto the wire during movement of the ram towards the terminal, and an actuator for moving the ram along the rectilinear path and applying the force F required to crimp the insulation support portion of the terminal onto the wire, the apparatus being characterized in that:

the ram is a composite member comprising a tool holder portion and a force transmitting portion which is in alignment with the tool holding portion, the crimping die and the inserter being on the tool holder portion, the actuator being in engagement with the force transmitting portion and being effective to move the actuator portion along the rectilinear path, a force transmitting compressible coupling is provided between the tool holder portion and the force-transmitting portion, the coupling being compressible upon application thereto of the force F required to crimp the insulation support portion onto the wire and being substantially incompressible under a force which is less than F whereby during insertion of a wire into the wire-receiving slot of the terminal and crimping of the insulation support portion of the terminal onto the wire, the resilient coupling will be compressed to an extent which will depend on the diameter of the wire, the extent of compression being greater for a larger diameter wire than for a smaller diameter wire.

2. An inserting and crimping apparatus as set forth in claim 1 characterized in that the compressible coupling comprises a compressed spring which is interposed between the force transmitting portion and the tool holder portion.

3. An inserting and crimping apparatus as set forth in claim 2 characterized in that the apparatus is a hand tool having a frame, the ram being reciprocably contained in the frame, the work holder and the wire positioner being on the frame.

4. An inserting and crimping apparatus as set forth in claim 2 characterized in that the tool holder portion of the ram is telescopically received in an axial bore in the force transmitting portion, the compressed spring being in the axial bore.

5. An inserting and crimping apparatus as set forth in claim 4 characterized in that the tool holder portion and the force transmitting portion are maintained in assembled relationship by a lost motion coupling which permits relative movement of the force transmitting portion towards the tool holder portion with accompanying compression of the spring.

6. An inserting and crimping apparatus as set forth in claim 5 characterized in that the lost motion coupling comprises a fastener extending slidably through the force transmitting portion to the tool holder portion, the fastener being fixed to the tool holder portion.

7. An inserting and crimping apparatus as set forth in claim 6 characterized in that the apparatus is a hand tool.

* * * * *